US009752237B2

(12) United States Patent
Smith et al.

(10) Patent No.: US 9,752,237 B2
(45) Date of Patent: Sep. 5, 2017

(54) CONTROL OF SUGAR EVAPORATOR SCALE USING SUGAR OR SUGAR MOIETIES

(71) Applicant: Ecolab USA Inc., St. Paul, MN (US)

(72) Inventors: Kim R. Smith, Woodbury, MN (US); Peter J. Fernholz, Burnsville, MN (US)

(73) Assignee: ECOLAB USA INC., Saint Paul, MN (US)

( * ) Notice: Subject to any disclaimer, the term of this patent is extended or adjusted under 35 U.S.C. 154(b) by 519 days.

(21) Appl. No.: 14/289,933

(22) Filed: May 29, 2014

(65) Prior Publication Data

US 2015/0345032 A1 Dec. 3, 2015

(51) Int. Cl.

| | |
|---|---|
| ***C23G 1/00*** | (2006.01) |
| ***C11D 3/20*** | (2006.01) |
| ***C11D 3/22*** | (2006.01) |
| ***C11D 3/33*** | (2006.01) |
| ***C11D 3/37*** | (2006.01) |
| ***C11D 11/00*** | (2006.01) |
| ***C11D 1/66*** | (2006.01) |
| ***C11D 7/26*** | (2006.01) |
| ***C11D 7/32*** | (2006.01) |

(52) U.S. Cl.

CPC ..... *C23G 1/00* (2013.01); *C11D 1/662* (2013.01); *C11D 3/2086* (2013.01); *C11D 3/2093* (2013.01); *C11D 3/221* (2013.01); *C11D 3/33* (2013.01); *C11D 3/3757* (2013.01); *C11D 7/26* (2013.01); *C11D 7/268* (2013.01); *C11D 7/3245* (2013.01); *C11D 11/0041* (2013.01)

(58) Field of Classification Search

CPC ..... C11D 3/2086

See application file for complete search history.

(56) References Cited

U.S. PATENT DOCUMENTS

| | | | | |
|---|---|---|---|---|
| 3,879,288 | A | 4/1975 | Siegele | |
| 3,981,779 | A | 9/1976 | Block et al. | |
| 4,126,606 | A | 11/1978 | Umezawa et al. | |
| 5,023,011 | A | 6/1991 | Busch et al. | |
| 6,235,151 | B1 | 5/2001 | Fagerlind et al. | |
| 6,585,933 | B1 | 7/2003 | Ehrhardt et al. | |
| 9,206,380 | B2 * | 12/2015 | Erickson | C11D 3/10 |
| 2002/0137658 | A1 | 9/2002 | Faber | |
| 2006/0042665 | A1 * | 3/2006 | Fernholz | A01J 7/022 134/42 |
| 2006/0142172 | A1 | 6/2006 | Cioletti et al. | |
| 2008/0029129 | A1 | 2/2008 | Mann | |
| 2008/0105282 | A1 * | 5/2008 | Fernholz | A01J 7/022 134/26 |
| 2008/0121250 | A1 * | 5/2008 | Fernholz | A01J 7/022 134/3 |
| 2008/0274933 | A1 * | 11/2008 | Fernholz | C11D 3/046 510/234 |
| 2009/0054290 | A1 * | 2/2009 | Fernholz | C11D 7/10 510/234 |
| 2009/0199875 | A1 * | 8/2009 | Fernholz | B08B 7/00 134/30 |
| 2009/0203567 | A1 * | 8/2009 | Fernholz | B01D 65/02 510/234 |
| 2009/0288683 | A1 * | 11/2009 | Cummings | C11D 3/3942 134/19 |
| 2009/0325841 | A1 * | 12/2009 | Erickson | C11D 3/3932 510/234 |
| 2010/0000579 | A1 * | 1/2010 | Reinbold | A23C 7/02 134/34 |
| 2010/0236581 | A1 * | 9/2010 | Fernholz | A01J 7/022 134/26 |
| 2010/0317559 | A1 * | 12/2010 | Ryther | C11D 3/044 510/218 |
| 2010/0317560 | A1 * | 12/2010 | Ryther | C11D 3/044 510/218 |
| 2011/0315168 | A1 | 12/2011 | Laffitte et al. | |
| 2012/0006671 | A1 | 1/2012 | Nowak | |
| 2012/0053111 | A1 | 3/2012 | Hodge et al. | |
| 2012/0260938 | A1 | 10/2012 | Zack et al. | |
| 2013/0035273 | A1 * | 2/2013 | Silvernail | C11D 3/044 510/467 |

(Continued)

FOREIGN PATENT DOCUMENTS

| | | | |
|---|---|---|---|
| CA | 2744738 | A1 | 1/2012 |
| CN | 101423298 | A | 5/2009 |

(Continued)

OTHER PUBLICATIONS

CA 2744738 A1—General Electric Company—English Translation Jan. 7, 2012.

CN 101423298 A—English Translation May 6, 2009.

EP 0 388 836 A1—Ciba-Geigy AG—English Translation Sep. 26, 1990.

JPS5429998 (B2)—Ciba-Geigy (UK) Ltd—English Abstract translation Feb. 4, 1974.

(Continued)

*Primary Examiner* — Gregory Webb

(74) *Attorney, Agent, or Firm* — McKee, Voorhees & Sease, PLC

(57) ABSTRACT

Methods of cleaning sugar evaporators with a cleaning composition comprising a sugar or sugar-moiety containing compound are disclosed. The methods are capable of improved scale and fouling removal from treated surfaces, including scale containing calcium oxalate, calcium dihydrogen phosphate, silica and/or other components from sugar evaporators. The methods reduce time required for scale removal without the need for highly alkaline cleaning compositions, elevated temperatures and/or mechanical force applied to the scale.

20 Claims, No Drawings

(56) References Cited

U.S. PATENT DOCUMENTS

| | | | | |
|---|---|---|---|---|
| 2013/0035274 | A1* | 2/2013 | Silvernail | C02F 5/145 510/469 |
| 2013/0035275 | A1* | 2/2013 | Silvernail | C11D 3/044 510/470 |
| 2013/0035276 | A1* | 2/2013 | Silvernail | C11D 3/044 510/470 |
| 2013/0035277 | A1* | 2/2013 | Silvernail | C11D 3/044 510/471 |
| 2013/0068254 | A1 | 3/2013 | Besse et al. | |
| 2013/0092197 | A1 | 4/2013 | Hodge et al. | |
| 2014/0093898 | A1 | 4/2014 | Johnson et al. | |
| 2014/0128310 | A1* | 5/2014 | Silvernail | C11D 3/044 510/476 |
| 2014/0261546 | A1* | 9/2014 | Erickson | C11D 3/10 134/8 |
| 2015/0345032 | A1* | 12/2015 | Smith | C11D 3/2086 134/7 |

FOREIGN PATENT DOCUMENTS

| | | | |
|---|---|---|---|
| EP | 0388836 | B1 | 9/1990 |
| EP | 0491391 | A1 | 6/1992 |
| EP | 0491391 | B1 | 6/1992 |
| EP | 0491391 | B2 | 6/1992 |
| JP | S5429998 | | 2/1974 |
| WO | 0066810 | A1 | 11/2000 |
| WO | 2004037965 | A1 | 5/2004 |
| WO | 2008137796 | A1 | 11/2008 |
| WO | 2012142396 | A1 | 10/2012 |

OTHER PUBLICATIONS

Interational Searching Authority, "International Search Report and Written Opinion", issued in connection to International Application No. PCT/US2015/032407, mailed Jul. 27, 2015, 15 pages.

* cited by examiner

CONTROL OF SUGAR EVAPORATOR SCALE USING SUGAR OR SUGAR MOIETIES

FIELD OF THE INVENTION

The invention relates to the field of evaporators and the cleaning thereof. In particular, the invention relates to cleaning compositions comprising a sugar or sugar-moiety capable of improved scale and fouling removal from treated surfaces, including scale containing calcium oxalate, calcium dihydrogen phosphate, silica and/or other components from sugar evaporators.

BACKGROUND OF THE INVENTION

In many industrial applications, such as the manufacture of foods and beverages, hard surfaces commonly become contaminated with soils such as carbohydrate, proteinaceous, and hardness soils, food oil soils and other soils. Such soils can arise from the manufacture of both liquid and solid foodstuffs. Food and beverage soils are particularly tenacious when they are heated during processing. Foods and beverages are heated for a variety of reasons during processing. For example, many food and beverage products are concentrated or created as a result of evaporation.

Specific examples of food and beverage products that are concentrated using evaporators include dairy products such as whole and skimmed milk, condensed milk, whey and whey derivatives, buttermilk, proteins, lactose solutions, and lactic acid; protein solutions such as soya whey, nutrient yeast and fodder yeast, and whole egg; fruit juices such as orange and other citrus juices, apple juice and other pomaceous juices, red berry juice, coconut milk, and tropical fruit juices; vegetable juices such as tomato juice, beetroot juice, carrot juice, and grass juice; starch products such as glucose, dextrose, fructose, isomerose, maltose, starch syrup, and dextrine; sugars such as liquid sugar, white refined sugar, sweetwater, and insulin; extracts such as coffee and tea extracts, hop extract, malt extract, yeast extract, pectin, and meat and bone extracts; hydrolyzates such as whey hydrolyzate, soup seasonings, milk hydrolyzate, and protein hydrolyzate; beer such as de-alcoholized beer and wort; and baby food, egg whites, bean oils, and fermented liquors.

There are generally at least two sides to an evaporator. One side holds the steam or vapor heat source (typically at temperatures of about 212° F. to 350° F.). The other side holds the process liquid to be concentrated. During the evaporation process, the liquid to be concentrated is introduced into the evaporator. The heat exchange across the tubes or plates evaporates water off the process stream concentrating the liquid solids. The liquid to be concentrated may be run through an evaporator several times (or a series of several evaporators) until it is sufficiently concentrated.

There are many different types of evaporators including falling film evaporators, forced circulation evaporated evaporators, plate evaporators, circulation evaporators, fluidized bed evaporators, falling film short path evaporators, rising film evaporators, counterflow-trickle evaporators, stirrer evaporators, and spiral tube evaporators. In addition to the evaporators, there are several other pieces of equipment in an evaporation plant including preheaters and heaters, separators, condensers, deaeration/vacuum systems, pumps, cleaning systems, vapor scrubbers, vapor recompression systems, and condensate polishing systems. All of the evaporation plant equipment should be cleaned, however, the actual evaporator typically has the most difficult soiling problems.

When a food or beverage product contacts any surface, soiling occurs where some part of the food or beverage product is left behind on that surface. When that surface is a heat exchange surface, the soil becomes thermally degraded rendering it even more difficult to remove. Over time, the layer of soil increases in thickness as more food or beverage product is passed over the heat exchange surface. The layer of soil acts as an insulator between the heat and the product being heated, thereby reducing the efficiency of the heat exchange surface and requiring more energy to create the same effect if the heat exchange surface were clean. When the heat exchange surface is an evaporator, the difference between a clean heat exchange surface and a soiled heat exchange surface can mean the difference in millions of dollars in energy costs for an evaporator plant. With the cost of energy increasing significantly, as well as an increased awareness of protecting the environment by preserving natural resources, there remains a need for cleaning programs that can clean heat exchange surfaces and create an efficient transfer a heat.

Cleaning techniques for removing scale and other fouling/soils from the internal components of the evaporators, including vessels or tanks, lines, and the like require passing cleaning solutions through the system (often without dismantling any system components such as commonly used in CIP techniques). The techniques involves allowing the cleaning solution to pass through the equipment and maintain contact with the scale or soil (such as in the vessels or tanks of the evaporators) before resuming normal processing. The process can also include any additional contacting and/or rinsing steps in which a rinse, acidic or basic functional fluid, solvent or other cleaning component such as hot water, cold water, etc. can be contacted with the equipment at any step during the process. The cleaning techniques require a complete shutdown of the equipment being cleaned, which results in lost production time. Many times, the equipment is not thoroughly cleaned. In many conventional cleaning processes for sugar evaporators, EDTA or other calcium chelants such as citric acid are applied at concentrations of at least about 5% to remove scale. The chelants can be provided in alkaline, neutral, or acidic solutions. Often, highly alkaline concentrations of EDTA at pH of at least about 11-12 are conventionally employed. However, such concentrations are often insufficient for removal of the scale and increased concentrations, such as 10% or greater, are applied at elevated pH, elevated temperature and/or using mechanical force to attempt to increase scale removal efficiency within sugar evaporators. There is still however a need for improved methods and compositions for cleaning this equipment.

It is against this background that the present invention has been made. In general, the prior art provides insufficient cleaning compositions and/or automated methods for the cleaning of evaporators, such as sugar evaporator. Therefore, improved cleaning compositions and processes are required to remove soils, deposits, and other impurities.

Accordingly, it is an objective of the claimed invention to develop sugar or sugar-moiety containing cleaning compositions for improved cleaning of evaporators.

According to the invention, it is desired to reduce the time and difficulty of cleaning evaporators by providing improved cleaning compositions.

A further object of the invention is to develop compositions and methods for use to completely remove scale from evaporators.

Other objects, advantages and features of the present invention will become apparent from the following specification taken in conjunction with the accompanying drawings.

BRIEF SUMMARY OF THE INVENTION

One aspect of the present invention is directed to a method of removing scale from a hard surface, such as an evaporator comprising: applying a sugar and/or sugar moiety-containing compound cleaning composition to a surface in need of scale removal, wherein the scale contains sugar and at least one soil selected from the group consisting of calcium oxalate, calcium dihydrogen phosphate, silica and combinations thereof; and contacting the scale with the cleaning composition for an amount of time sufficient to dissolve the sugar in the scale.

Another aspect of the present invention is directed to a method of cleaning an evaporator comprising the steps of: applying a sugar and/or sugar moiety-containing compound cleaning composition to a surface in need of scale removal, wherein the scale contains sugar and at least one soil selected from the group consisting of calcium oxalate, calcium dihydrogen phosphate, silica and combinations thereof; contacting the scale with the cleaning composition for an amount of time sufficient to dissolve the sugar in the scale; and reducing the amount of time required for removing the scale in comparison to a cleaning composition consisting essentially of a calcium chelant.

Still another aspect of the present invention is directed to a cleaning composition capable of dissolving a solid scale source comprising: from about 0.5 wt-% to about 5 wt-% of sugar and/or sugar moiety-containing compound, from about 0 wt-% to about 5 wt-% of a calcium chelant, and water. In an aspect, the sugar and/or sugar moiety-containing compound is a monosaccharide and/or disaccharide selected from the group consisting of glucose, sucrose, fructose and combinations thereof, and/or an alkylpolysacharride selected from the group consisting of an alkyl polyglycoside, alkyl polyglucoside and combinations thereof. In a further aspect, the chelant is an aminocarboxylic acid, polyacrylate, carboxylate, and/or hydroxyacid salt. In a still further aspect, the cleaning composition dissolves sugar from a scale source scale containing sugar and at least one soil selected from the group consisting of calcium oxalate, calcium dihydrogen phosphate, silica and combinations thereof. In a still further aspect, the cleaning composition reduces the time required for removing said scale from a hard surface in comparison to a cleaning composition consisting of a chelant.

DETAILED DESCRIPTION OF THE PREFERRED EMBODIMENT

The present invention relates to cleaning compositions comprising a sugar and/or sugar moiety for use in cleaning scale from sugar evaporators. The compositions of the invention provide a reduced or eliminated use of conventional EDTA for cleaning as a result of employing a sugar solution or sugar moiety-containing solution to dissolve sugar solidified within the scale source. The compositions can be used on a variety of hard surfaces and methods of employing the same are provided within the scope of the invention.

The embodiments of this invention are not limited to particular sugar evaporator compositions and methods of employing the same, which can vary and are understood by skilled artisans. It is further to be understood that all terminology used herein is for the purpose of describing particular embodiments only, and is not intended to be limiting in any manner or scope. For example, as used in this specification and the appended claims, the singular forms "a," "an" and "the" can include plural referents unless the content clearly indicates otherwise. Further, all units, prefixes, and symbols may be denoted in its SI accepted form. Numeric ranges recited within the specification are inclusive of the numbers defining the range and include each integer within the defined range.

So that the present invention may be more readily understood, certain terms are first defined. Unless defined otherwise, all technical and scientific terms used herein have the same meaning as commonly understood by one of ordinary skill in the art to which embodiments of the invention pertain. Many methods and materials similar, modified, or equivalent to those described herein can be used in the practice of the embodiments of the present invention without undue experimentation, the preferred materials and methods are described herein. In describing and claiming the embodiments of the present invention, the following terminology will be used in accordance with the definitions set out below.

The term "about," as used herein, refers to variation in the numerical quantity that can occur, for example, through typical measuring and liquid handling procedures used for making concentrates or use solutions in the real world; through inadvertent error in these procedures; through differences in the manufacture, source, or purity of the ingredients used to make the compositions or carry out the methods; and the like. The term "about" also encompasses amounts that differ due to different equilibrium conditions for a composition resulting from a particular initial mixture. Whether or not modified by the term "about", the claims include equivalents to the quantities.

The term "actives" or "percent actives" or "percent by weight actives" or "actives concentration" are used interchangeably herein and refers to the concentration of those ingredients involved in cleaning expressed as a percentage minus inert ingredients such as water or salts.

As used herein, the term "waters" includes food process or transport waters. Food process or transport waters include produce transport waters (e.g., as found in flumes, pipe transports, cutters, slicers, blanchers, retort systems, washers, and the like), belt sprays for food transport lines, boot and hand-wash dip-pans, third-sink rinse waters, and the like. Waters also include domestic and recreational waters such as pools, spas, recreational flumes and water slides, fountains, and the like.

The term "weight percent," "wt-%," "percent by weight," "% by weight," and variations thereof, as used herein, refer to the concentration of a substance as the weight of that substance divided by the total weight of the composition and multiplied by 100. It is understood that, as used here, "percent," "%," and the like are intended to be synonymous with "weight percent," "wt-%," etc.

The methods and compositions of the present invention may comprise, consist essentially of, or consist of the components and ingredients of the present invention as well as other ingredients described herein. As used herein, "consisting essentially of" means that the methods and compositions may include additional steps, components or ingredients, but only if the additional steps, components or ingredients do not materially alter the basic and novel characteristics of the claimed methods and compositions.

Cleaning Compositions

Cleaning compositions comprising a sugar and/or sugar moiety in solution for use in cleaning scale from sugar evaporators is provided. The use solutions may be combined with a conventional chelant, such as EDTA, for removing scale from a variety of hard surfaces within a sugar evaporator. It is surprising that the methods of employing the sugars or sugar moiety-containing compounds act to reduce and remove the scale within the sugar evaporators, including such removal at decreased cleaning time. In an aspect, the cleaning compositions are suitable for use in removing scale containing one or more members selected from the group consisting of calcium oxalate, calcium dihydrogen phosphate and silica, such as those conventionally found in sugar evaporators. Additional water insoluble soils (inorganics) are also solidified within the scale found in sugar evaporators.

While an understanding of the mechanism is not necessary to practice the present invention and while the present invention is not limited to any particular mechanism of action, it is contemplated that, in some embodiments, the cleaning compositions comprising a sugar or sugar moiety-containing compound act to dissolve the solidified or caramelized sugar present in the solid scale to effectively remove the binder holding the scale into a solid, difficult to dissolve scale. As one skilled in the art appreciates, when the binder holding the scale together is dissolved, the remaining soils are broken apart by the aqueous solution due to the insolubility thereof. As a result, the cleaning compositions according to the invention are disintegrated into fine, silt-like material which can be easily washed away from the treated surfaces to which the cleaning composition is applied.

Sugars

In some embodiments of the invention at least one sugar is employed to provide an aqueous sugar composition. According to an embodiment of the invention suitable sugars include those carbohydrates having one, two, or more saccharose groups (e.g. monosaccharides or disaccharides). As referred to herein, sugars are a group of organic compounds related by molecular structure that comprise simpler members of the general class of carbohydrates. Each sugar consists of a chain of 2 to 7 carbon atoms (usually 5 or 6). Sugars have the general formula $C_nH_{2n}O_n$, wherein n is between 2 and 7. One of the carbons carries aldehydic or ketonic oxygen which may be combined in acetal or ketal forms and the remaining carbon atoms usually bear hydrogen atoms and hydroxyl groups. In general, sugars are more or less sweet, water soluble, colorless, odorless, optically active substances which lose water, caramelize and char when heated. Sugar can be straight-chained or ring structure. Sugar can be the L- or D-isomer of the sugar.

In an aspect of the invention, suitable sugars for use in the cleaning compositions include, but are not limited to, glucose, sucrose, fructose and mixtures thereof. In a preferred aspect, sucrose is employed as the sugar for the aqueous solutions according to the invention.

Additional monosaccharides include glucose, fructose, galactose, xylose, and ribose. Monosaccharides also include erythrose, threose, arabinose, lyxose, allose, altrose, mannose, gulose, idose, talose, erythrulose, ribulose, xylulose, psicose, sorbose, and tagatose. Additional disaccharides include sucrose, lactulose, lactose, maltose, trehalose, and cellobiose. Disaccharides also include kojibiose, nigerose, isomaltose, sophorose, laminaribiose, gentiobiose, turanose, maltulose, palatinose, gentiobiulose, mannobiose, melibiose, melibiulose, rutinose, rutinulose, and xylobiose.

In an additional aspect, sugars can include a polyfunctional sugar derivative such as a sugar alcohol. Sugar alcohols include glycol, glycerol, erythritol, threitol, arabitol, xylitol, ribitol, mannitol, sorbitol, dulcitol, iditol, isomalt, malitol, polyglycitol, and lacitol.

In an additional embodiment, the compositions of the invention utilize a combination of several different sugars. In such an embodiment, the sugars may be provided in a use solution at different or the same use concentrations.

In an aspect, the sugar is provided in sufficient amount to generate a use solution having a concentration between about 0.5 wt-% to about 5 wt-%, from about 1 wt-% to about 5 wt-%, or from about 1 wt-% to about 4 wt-%. It is to be understood that all ranges and values between these ranges and values are encompassed by the present invention.

Sugar Moieties—Alkylpolysaccharides

In some embodiments of the invention at least one sugar moiety-containing compound is employed to provide an aqueous sugar composition. In an aspect, a sugar moiety includes at least one aldehydic or ketonic oxygen which may be combined in acetal or ketal form and is selected from the group consisting of glucose functional groups, fructose functional groups, sucrose functional groups and combinations thereof.

According to an embodiment of the invention alkylpolysaccharides provide suitable sugar moieties. In an aspect, the alkylpolysaccharides are alkyl polyglycosides or alkyl polyglucosides, which are referred to simultaneously herein.

In an aspect, the alkylpolysaccharides are alkyl polyglucosides. In a further aspect, quaternary functionalized alkyl polyglucoside can be employed. The quaternary functionalized alkyl polyglucoside is naturally derived from alkyl polyglucosides and has a sugar backbone, as shown in the following representative formula:

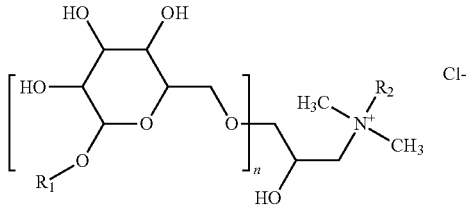

wherein $R_1$ is an alkyl group having from about 6 to about 22 carbon atoms, and $R_2$ is $CH_3(CH_2)_n$ where n is an integer ranging from 0-21. Additional disclosure of alkyl polyglucosides is found in U.S. application Ser. No. 13/331,990, which is herein incorporated by reference in its entirety.

Examples of commercially-available alkylpolysaccharides useful in the present include but are not limited to Glucopon® 425 surfactant (an alkyl polyglucoside in which the alkyl group contains 8 to 16 carbon atoms and having an average degree of polymerization of 1.48); Glucopon® 625 surfactant (an alkyl polyglucoside in which the alkyl groups contains 12 to 16 carbon atoms and having an average degree of polymerization of 1.6); APG® 325 surfactant (an alkyl polyglucoside in which the alkyl groups contains 9 to 11 carbon atoms and having an average degree of polymerization of 1.5); and Glucopon® 600 surfactant (an alkyl polyglucoside in which the alkyl groups contains 12 to 16 carbon atoms and having an average degree of polymerization of 1.4).

In an additional embodiment, the compositions of the invention utilize a combination of several different sugar moiety-containing compounds. In such an embodiment, the sugars may be provided in a use solution at different or the same use concentrations. In an aspect of the invention, suitable sugar moiety-containing compounds can be combined with sugars for use in the cleaning compositions.

In an aspect, the sugar moiety-containing compound is provided in sufficient amount to generate a use solution having a concentration between about 0.5 wt-% to about 5 wt-%, from about 1 wt-% to about 5 wt-%, or from about 1 wt-% to about 4 wt-%. It is to be understood that all ranges and values between these ranges and values are encompassed by the present invention.

Water

Water is employed in the cleaning compositions according to the invention to provide an aqueous solution. Water may be independently added to compositions as well as further diluted to form a use solution having a desired use concentration. The water may optionally be provided as deionized water or as softened water, although not necessary for cleaning efficacy according to embodiments of the invention.

The amount of water in the cleaning composition will depend on the desired use solution concentration of the active (sugar, sugar moiety and/or other active ingredients). In general, water may be present in ranges of between about 50 wt-% and about 99.9 wt-%, about 75 wt-% and about 99 wt-%. It is to be understood that all ranges and values between these ranges and values are encompassed by the present invention.

Additional Functional Ingredients

In some embodiments, the compositions of the present invention can include other additional functional ingredients. Additional functional ingredients suitable for use with the compositions of the present invention include, but are not limited to, stabilizing agents, e.g., chelating agents, solvents/penetrants, acidulants, alkalinity sources, sequestrants and/or crystallization inhibitors, threshold agents, buffers, detergents, wetting agents, defoaming agents, thickeners, foaming agents, aesthetic enhancing agents (i.e., colorants, odorants, or perfumes) and other scale removal agents. Additional functional ingredients are disclosed in U.S. Publication Nos. 2014/0093898, 2008/0029129, 2010/0236581, and 2008/0121250, each of which are herein incorporated by reference in their entirety.

These additional ingredients can be preformulated with the compositions of the invention or added to the system before, after, or substantially simultaneously with the addition of the compositions of the present invention.

Chelants/Sequestrants

In some aspects of the invention, the cleaning compositions may include a calcium chelant or sequestrant (e.g. builders) in combination with the sugar or sugar moiety-containing compound. Without being limited to a mechanism of action according to the invention, inclusion of a calcium chelant or sequestrant can effectively complex and remove such compounds or cations from the treated, soiled surfaces. In an aspect, the chelant or sequestrant can include, but is not limited to: aminocarboxylic acids, polyacrylates, carboxylates, or hydroxyacid salts, such as citric acid or salts thereof.

Carboxylates such as citrate or gluconate are suitable. Useful aminocarboxylic acid materials containing little or no NTA include, but are not limited to: N-hydroxyethylaminodiacetic acid, ethylenediaminetetraacetic acid (EDTA), hydroxyethylenediaminetetraacetic acid, diethylenetriaminepentaacetic acid, N-hydroxyethyl-ethylenediaminetriacetic acid (HEDTA), diethylenetriaminepentaacetic acid (DTPA), and other similar acids having an amino group with a carboxylic acid substituent.

Polycarboxylates that can be used include, but are not limited to: those having pendant carboxylate ($—CO_{2-}$) groups such as polyacrylic acid, maleic acid, maleic/olefin copolymer, sulfonated copolymer or terpolymer, acrylic/maleic copolymer, polymethacrylic acid, acrylic acid-methacrylic acid copolymers, hydrolyzed polyacrylamide, hydrolyzed polymethacrylamide, hydrolyzed polyamide-methacrylamide copolymers, hydrolyzed polyacrylonitrile, hydrolyzed polymethacrylonitrile, and hydrolyzed acrylonitrile-methacrylonitrile copolymers.

Additional discussion of chelating agents/sequestrants is set forth in Kirk-Othmer, Encyclopedia of Chemical Technology, Third Edition, volume 5, pages 339-366 and volume 23, pages 319-320, the disclosure of which is incorporated by reference herein.

In an aspect, the chelant is provided in sufficient amount to generate a use solution having a concentration between about 0 wt-% to about 20 wt-%, from about 0.5 wt-% to about 10 wt-%, or from about 1 wt-% to about 5 wt-%. It is to be understood that all ranges and values between these ranges and values are encompassed by the present invention.

Surfactants

In some aspects of the invention, the cleaning compositions may include a surfactant. Surfactants may be included in the compositions to enhance scale removal and cleaning efficacy. Surfactants suitable for use with the compositions of the present invention are disclosed for example in Kirk-Othmer, Encyclopedia of Chemical Technology, Third Edition, volume 8, pages 900-912, which is herein incorporated by reference in its entirety. Particularly suitable surfactants for use according to embodiments of the invention include, nonionic surfactants, anionic surfactants, amphoteric surfactants, and cationic surfactants.

Exemplary Compositions

Various embodiments of the invention are shown in Table 1 depicting suitable use compositions according to the invention.

TABLE 1

| | Wt-% | Wt-% | Wt-% |
|---|---|---|---|
| Sugar or sugar moiety containing compound | 0.5-5 | 1-5 | 2-5 |
| Calcium Chelant | 0-5 | 0.5-5 | 1-5 |
| Additional Functional Ingredients | 0-50 | 0-25 | 0-10 |
| Water | 50-99.5 | 50-99 | 50-95 |

Use solutions of the cleaning compositions according to the invention have a neutral to alkaline pH. An example of a suitable cleaning composition pH is from about 6 to about 12, from about 7 to about 11, from about 7 to about 10, from about 7 to about 9, from about 7 to about 8, or about 7. The cleaning composition pH is maintained in the neutral to slightly alkaline range to ensure acid does not disrupt or break sugar moieties provided for scale dissociation according to the invention.

The cleaning compositions can be formulated and/or provided as concentrate compositions or use compositions. For example, a concentrate composition can be diluted, for example with water, to form a use composition. In an embodiment, a concentrate composition can be diluted to a use solution before to application to a surface. Primarily for reasons of economics, the concentrate can be marketed and an end user can dilute the concentrate with water or an aqueous diluent to a use solution.

Methods of Removing Scale

Methods of use according to the invention are suitable for removing scale from a treated hard surface, including an evaporator used in food or beverage processing. Hard surfaces having scaling from evaporation processes, including sugar evaporation, are suitable for scale removal and cleaning according to the invention. Scale from sugar evaporation is commonly recognized to contain calcium oxalate, calcium dihydrogen phosphate and/or silica. The scale is a solid, block-like soil that has a darkened appearance as it is found in increasing effects of a multi-effect evaporator. For example, the methods of use according to the invention are suitable for removing the solid, light tan scale appearing in first evaporator effect, and the solid, dark brown scale appearing in fifth evaporator effect (and greater), as well as the scale found in between such multi-effect evaporators. Although the soil or scale content differs between the various effects of an evaporator (e.g. first effect is richer in oxalate than later effects), the methods of use according to the invention unexpectedly remove the scale to provide beneficial cleaning efficacy of the evaporator.

The methods of removing scale employing the cleaning compositions described herein may comprise, consist of and/or consist essentially of providing a neutral or alkaline cleaning composition comprising a sugar and/or sugar moiety-containing compound to an evaporator or other hard surface to be treated and contacting the scale with the cleaning composition. The contacting of the cleaning composition may occur through the direct application of the cleaning composition, including for example, filling a vessel or tank with the solution. The contacting of the cleaning composition may also occur through numerous other methods of application, such as spraying the composition (e.g. spray ball) with or without pressure, other forms of automatic application, immersing the surface in the composition, such as filling a vessel or tank with the cleaning composition solution, or a combination thereof. In a preferred embodiment, the contacting of the cleaning compositions occurs through spraying the use solution of the cleaning composition to soak the scale adhered to the hard surface.

In an aspect, the step of contacting the surface containing the scale with the cleaning composition may occur for a period of time sufficient to dissolve the scale and dissociate the inorganic soil components from the solid scale. In an aspect, the contact of the surface with the cleaning composition may range from a few seconds to a few minutes.

A concentrate or use concentration of the cleaning compositions can be employed for the contacting step according to the invention. If a concentrate cleaning composition is employed a diluent is first provided to generate the use solution to be applied to the hard surface of the evaporator in need of scale removal.

The methods may further comprise, consist of and/or consist essentially of draining the cleaning composition from the evaporator to remove the dissolved scale and soil remnants from the evaporator. The methods may further comprise, consist of and/or consist essentially of a rinse step and/or repeating the contacting step with a new solution of the cleaning composition. Still further, the methods may further comprise, consist of and/or consist essentially of applying the cleaning compositions at an elevated temperature (e.g. above room temperature), applying the cleaning composition with agitation or other form of mechanical force, although beneficially according to the invention the improved cleaning compositions capable of dissolving the scale do not require use of either elevated temperature and/or mechanical force (such as scrubbing or sand blasting). As referred to herein, agitation can be by physical scrubbing, through the action of the spray solution under pressure, through sonication, or by other methods.

Preferably the methods of cleaning to remove scale are particularly suitable for use at approximately neutral pHs. According to the invention, the methods of using the cleaning compositions comprising a sugar and/or sugar moiety-containing compound have a use solution pH from about 6 or above.

Additional description of automated methods for cleaning heat exchangers and/or evaporators is set forth, for example, in U.S. Pat. No. 7,794,547, and U.S. Publication Nos. 2008/0029129, 2010/0236581, 2008/0121250 which are incorporated herein by reference in its entirety.

In an aspect of the invention, the methods reduce the time required for cleaning evaporators to remove scale. Improvements in time required for removing scale from evaporators according to the invention are compared to conventional cleaning using 5% solutions of tetrasodium EDTA (wherein 30 minute contact time or soak time result in little effect of soil dissolution or removal from hard surfaces). Without being limited according to the invention, in some aspects the cleaning time is reduced by at least 50% in comparison to conventional cleaning using 5% EDTA chelant solutions, in other aspects, the cleaning time is reduced by at least 60% in comparison to conventional cleaning using 5% EDTA chelant solutions, or more preferably cleaning time is reduced by at least 70% or at least 75% or greater.

All publications and patent applications in this specification are indicative of the level of ordinary skill in the art to which this invention pertains. All publications and patent applications are herein incorporated by reference to the same extent as if each individual publication or patent application was specifically and individually indicated as incorporated by reference.

EXAMPLES

Embodiments of the present invention are further defined in the following non-limiting Examples. It should be understood that these Examples, while indicating certain embodiments of the invention, are given by way of illustration only. From the above discussion and these Examples, one skilled in the art can ascertain the essential characteristics of this invention, and without departing from the spirit and scope thereof, can make various changes and modifications of the embodiments of the invention to adapt it to various usages and conditions. Thus, various modifications of the embodiments of the invention, in addition to those shown and described herein, will be apparent to those skilled in the art from the foregoing description. Such modifications are also intended to fall within the scope of the appended claims.

Example 1

Scale was removed from the internal surface of a commercial, multi-effect sugar evaporator. As referred to herein, the multi-effect evaporator uses heat from steam to evaporate water from a sugar composition, wherein water is boiled in a sequence of vessels (each having lower pressure than the previous) and the vapor boiled off from a vessel is thereafter used as the heat for the next vessel. A five effect sugar evaporator was used to obtain a scale source for evaluation of cleaning compositions according to the invention.

The solid scale was placed in a specimen cup and cleaning compositions were added to each specimen cup as an aqueous solution. The cleaning compositions were allowed 5 minutes contact time at ambient temperature and without agitation before the solid scale was filtered from the specimen cup and photographed for a visual analysis of the impact of the cleaning composition on the scale. The test compositions and results are shown in Table 2. The control employed was a 5% solution of $Na_4EDTA$.

TABLE 2

| Cleaning Composition | Exposure | pH | Result |
|---|---|---|---|
| None | — | — | Solid, hard chunks of scale |
| Control | 5 min | Neutral | Smaller sized, solid, hard chunks of scale |
| 1% Sucrose | 5 min | Neutral | Scale disintegrated into small, easily handled particulates |
| 1% Fructose | 5 min | Neutral | Scale disintegrated into small, easily handled particulates |
| 1% Glucose | 5 min | Neutral | Scale disintegrated into small, easily handled particulates |

Advantageously, the addition of the various sugar solutions to the solid scale provided a means of breaking apart (disintegrating) the scale into particulates. The evaluated sugar solutions all outperformed the control of 5% solution of $Na_4EDTA$, despite the lower concentration of the cleaning compositions. As a result the sugar solutions were further evaluated for use in sugar evaporator scale treatment.

Example 2

The 1% Sucrose cleaning composition of Example 1 was further evaluated to determine suitable use solution concentration the sugar cleaning compositions according to the invention. Additional solid scale (as described in Example 1) was evaluated according to the same test conditions as set forth in Example 1. The test compositions and results are shown in Table 3.

TABLE 3

| Cleaning Composition | Exposure | pH | Result |
|---|---|---|---|
| 1% Sucrose | 5 min | Neutral | Scale disintegrated into small, easily handled particulates |
| 2% Fructose | 5 min | Neutral | Scale disintegrated into smaller particulates |
| 5% Glucose | 5 min | Neutral | Scale disintegrated into the smallest particulates of the test |

The results show that a <1% use solution concentration could also be utilized according to the invention. There was demonstrated increased efficacy of the disintegration of the solid scale with the increasing use solution concentrations of the sucrose. However, the use solution could be decreased <1% and/or employ the 1% solution while providing increased time for cleaning efficacy, by employing agitation and/or other mechanical force to break apart scale, and the like.

Example 3

Additional cleaning compositions employing sugar moieties were evaluated according to the test conditions as set forth in Example 1. The test compositions and results are shown in Table 4. The control employed was a 5% solution of $Na_4EDTA$. The 1% alkylpolyglycoside employed was a C—C14 natural fatty alcohol based alkylpolyglycoside surfactant (commercially available from BASF, Corp. as Glucopon® 425)

TABLE 4

| Cleaning Composition | Exposure | pH | Result |
|---|---|---|---|
| None | — | — | Solid, hard chunks of scale |
| Control | 5 min | Neutral | Smaller sized, solid, hard chunks of scale |
| 1% Alkylpoly-glycoside | 5 min | Neutral | Scale disintegrated into small, easily handled particulates |

Advantageously, the addition of the alkylpolyglycoside solution to the solid scale provided a means of breaking apart (disintegrating) the scale into particulates. The evaluated alkylpolyglycoside solution outperformed the control of 5% solution of $Na_4EDTA$, despite the lower concentration of the cleaning compositions. As a result the alkylpolyglycoside solution was further evaluated for use in sugar evaporator scale treatment.

Example 4

The 1% alkylpolyglycoside cleaning composition of Example 3 was further evaluated to determine whether improved efficacy would be achieved when using a combination of EDTA with the alkylpolyglycoside. Additional solid scale (as described in Example 1) was evaluated according to the same test conditions as set forth in Example 1. A 1% alkylpolyglycoside/2% $Na_4EDTA$ solution resulted in the immediate disintegration of the solid scale into a fine, silt-like material that was able to pass through the filter.

The inventions being thus described, it will be obvious that the same may be varied in many ways. Such variations are not to be regarded as a departure from the spirit and scope of the inventions and all such modifications are intended to be included within the scope of the following claims.

What is claimed is:

1. A method of removing scale from a hard surface comprising:

applying a cleaning composition to a scale from a hard surface in need of scale removal, wherein the scale contains sugar and at least one soil selected from the group consisting of calcium oxalate, calcium dihydrogen phosphate, silica and combinations thereof; and contacting the scale with the cleaning composition for an amount of time to dissolve the sugar in the scale, wherein the cleaning composition comprises a monosaccharide, disaccharide, or combination thereof.

2. The method of claim 1, wherein the cleaning composition is a use solution providing from about 0.5 wt-% to about 5 wt-% of said monosaccharide and/or disaccharide, and wherein said cleaning composition use solution has a pH above about 6.

3. The method of claim 1, wherein the cleaning composition comprises a disaccharide.

4. The method of claim 1, wherein the monosaccharide and/or disaccharide are selected from the group consisting of glucose, sucrose, fructose and combinations thereof.

5. The method of claim 1, wherein the cleaning composition further comprises a calcium chelant.

6. The method of claim 5, wherein the chelant is an aminocarboxylic acid, polyacrylate, carboxylate, and/or hydroxyacid salt.

7. The method of claim 5, wherein the chelant is EDTA and/or citric acid.

8. The method of claim 1, wherein the cleaning composition comprises at least one monosaccharide.

9. The method of claim 8, wherein the monosaccharide is glucose or fructose.

10. The method of claim 9, wherein the cleaning composition further comprises a calcium chelant.

11. The method of claim 10, wherein the chelant is an aminocarboxylic acid, polyacrylate, carboxylate, and/or hydroxyacid salt.

12. The method of claim 10, wherein the chelant is EDTA and/or citric acid.

13. The method of claim 1, wherein the hard surface is a surface of a processing equipment in contact or connection with an evaporator.

14. A method of removing scale from a sugar evaporator comprising:

applying a cleaning composition to a surface of a sugar evaporator in need of scale removal, wherein the scale contains sugar and at least one soil selected from the group consisting of calcium oxalate, calcium dihydrogen phosphate, silica and combinations thereof; and contacting the scale with the cleaning composition for an amount of time to dissolve the sugar in the scale, wherein the cleaning composition comprises a monosaccharide, disaccharide, or combination thereof.

15. The method of claim 14, wherein the cleaning composition is a use solution providing from about 0.5 wt-% to about 5 wt-% of said monosacharide and/or disaccharide, and from about 0 wt-% to about 5 wt-% of a calcium chelant, and wherein said cleaning composition use solution has a pH above about 6.

16. The method of claim 15, wherein the cleaning composition comprises a monosaccharide, disaccharide selected from the group consisting of glucose, sucrose, fructose, and combination thereof.

17. The method of claim 15, wherein the cleaning composition further comprises a calcium chelant selected from the group consisting of an aminocarboxylic acid, polyacrylate, carboxylate, hydroxyacid salt and combinations thereof.

18. The method of claim 15, wherein the chelant is EDTA and/or citric acid, and wherein the cleaning composition consists essentially of from about 0.5 wt-% to about 2 wt-% of said monosaccharide and/or disaccharide and from about 0.5 wt-% to about 2 wt-% of said chelant.

19. The method of claim 14, wherein the amount of time is from about 30 seconds to about 5 minutes.

20. A cleaning use solution composition capable of dissolving a solid scale source comprising:

from about 0.5 wt-% to about 5 wt-% of a monosaccharide, disaccharide, or combination thereof, wherein said monosaccharide and/or disaccharide is selected from the group consisting of glucose, sucrose, fructose, and combination thereof;

from about 0.5 wt-% to about 5 wt-% of a calcium chelant, wherein the chelant is an aminocarboxylic acid, polyacrylate, carboxylate, and/or hydroxyacid salt; and water, wherein said cleaning composition has a pH above about 6;

wherein said cleaning composition dissolves sugar from a scale containing sugar and at least one soil selected from the group consisting of calcium oxalate, calcium dihydrogen phosphate, silica and combinations thereof.

* * * * *